United States Patent [19]

Warehime

[11] 4,352,497

[45] Oct. 5, 1982

[54] FOOTBALL (SOCCER) GAME WITH MOBILE GOALS

[76] Inventor: Norwood R. Warehime, 704 W. 34th St., Baltimore, Md. 21211

[21] Appl. No.: 215,649

[22] Filed: Dec. 12, 1980

[51] Int. Cl.[3] ..... A63B 71/02; A63B 63/04

[52] U.S. Cl. ..... 273/411; 273/390; 273/127 R; 273/58 C

[58] Field of Search ..... 273/58 C, 411, 378, 273/386, 390, 333, 127 D, 118 R, 108, 127 R

[56] References Cited

U.S. PATENT DOCUMENTS

| | | | |
|---|---|---|---|
| 437,267 | 9/1890 | Walker | 273/386 |
| 3,785,643 | 1/1974 | Rich | 273/58 C X |

FOREIGN PATENT DOCUMENTS

| | | | |
|---|---|---|---|
| 592723 | 2/1934 | Fed. Rep. of Germany | 273/58 C |
| 19786 | of 1909 | United Kingdom | 273/58 C |
| 838470 | 6/1960 | United Kingdom | 273/411 |
| 2030048 | 4/1980 | United Kingdom | 273/411 |

OTHER PUBLICATIONS

General Sportcraft Inc., Bergenfield, N.J., 1978 Catalogue, p. 37.

*Primary Examiner*—George J. Marlo

[57] ABSTRACT

The invention provides mobile game play goals in form of tether balls with various types of tether anchors, depending on types of playing surface and game field pattern. The mobile goals are employed in various field patterns for novel football (soccer) play whereby competing teams try to kick a free football (soccer ball) against their mobile goal for a score. The invention describes four different field patterns for mobile goals and associated game play. Tether ropes can range from 1 to 5 yds (mts) in length. Tether anchors can be in form of stake or inverted "U" pin for soft playing surface, and in form of a weighted disc for impenetrable playing surface such as concrete, asphalt, or wood. An optional form of mobile goals uses two tether balls connected by a tether from 2 to 10 yds (mts) in length, thus providing a free-to-move (non-anchored) pair of goals which can be used in novel game play. Subject goals are portable, economical, vandal-proof, versatile in set-up on various playing surfaces, suitable for small playing areas, require no field markings, and provide ideal means for football (soccer) competition or practice.

4 Claims, 10 Drawing Figures

FOOTBALL (SOCCER) GAME WITH MOBILE GOALS

TECHNICAL FIELD

The invention relates to football (soccer) games with mobile goals; footballs (soccer balls) having 1 to 5 yds (mts) long tethers with various anchor means are used as mobile goals against which competing team players attempt to kick a free football (soccer ball) for a score. Various field patterns are used for disposition of 2, 3, or 4 mobile goals. Another mobile goal variation uses a non-anchored pair of balls with a 2 to 10 yds (mts) long tether therebetween.

BACKGROUND ART

No related patents or other documents have been noted. Standard football (soccer) game play and standard tether balls might be mentioned as general background art of invention. Reference is made to 1978 catalogue, page 37, of General Sportcraft Inc. of Bergenfield, N.J., USA, which shows two official size tether balls, one with a built-in external loop attachment for tether, and one with a recessed hanger for tether. Both balls approximate size of standard football (soccer ball). Nylon ropes are used as tether medium. Cited tether balls are usually attached to an upright pole and hit with hand or fist in game play. Some variations of tether ball use include football (soccer) practice with long tether medium of rope or rubber band or rubber tubing, with ball being kicked while tether is attached to stake in earth. However, in no instance has it been noted that tether ball was used as a mobile goal in game play.

DISCLOSURE OF INVENTION

The invention as claimed is intended to provide simple, effective, challenging, and economical mobile goals for use in a variety of novel football (soccer) type games that can be played by competing teams on a variety of playing surfaces, both indoors and outdoors, especially where size of playing area is limited. The invention solves the problem of how to design: (a) simple tethered mobile goals using tether balls with anchoring means for various types of playing surfaces: (b) simple set of paired tether balls connected together which is used as mobile goals for two competing teams but without anchor means; and (c) various football (soccer) games using field patterns and playing rules in conjunction with 2, 3, or 4 mobile goals.

The advantages offered by subject mobile goals as compared to conventional goals in football (soccer) game play are: subject goals are portable, economical, vandal-proof, versatile in set-up on various playing surfaces, suitable for use in small playing area, and require no field markings. Another advantage offered by subject goals is additional novel element of game play which allows players to kick mobile goal balls in both offensive and defensive maneuvers for game play advantage. Also, the smallness of the mobile goals require challenging skill, strategy, and teamwork of players to make free ball contact mobile goal for a score. In general, the use of mobile goals in subject novel games is ideal for formal and informal game play with minimum set-up requirements and allows a wide range of players per team to participate. In addition, one type of game play involves three teams competing at one time, a novel variation in football (soccer).

BRIEF DESCRIPTION OF DRAWINGS

The invention is described in detail with reference to drawings which illustrate several embodiments of tether ball systems and game play patterns, in which.

DESCRIPTION AND PREFERRED EMBODIMENTS FOR CARRYING OUT INVENTION

Figure 1:
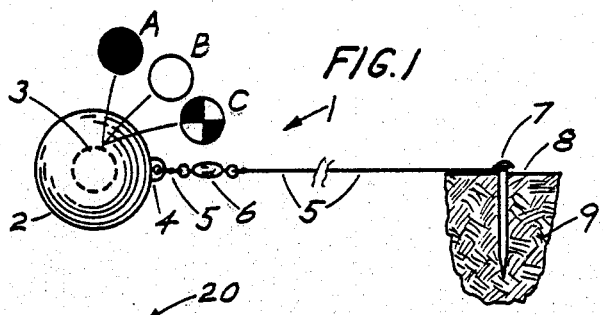
FIG. 1 is a side view of ball, tether, swivel, and exposed anchor stake, with three different team mobile goal ball designations indicated.
Figure 3:
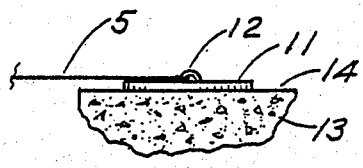
FIG. 3 is a side view of optional disc-shaped weighted tether anchor with exposed impenetrable playing surface.
Figure 5:
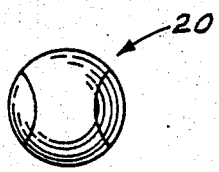
FIG. 5 is a view of a free standard football (soccer ball)
Figure 2:
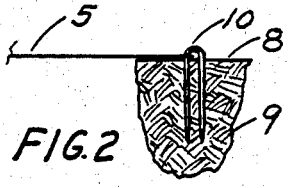
FIG. 2 is a side view of exposed optional tether anchor pin having inverted "U" shape.
Figure 4:
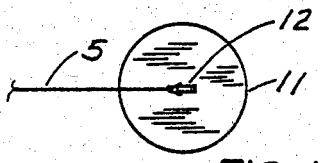
FIG. 4 is a top view of weighted tether anchor of FIG. 3.
Figure 6:
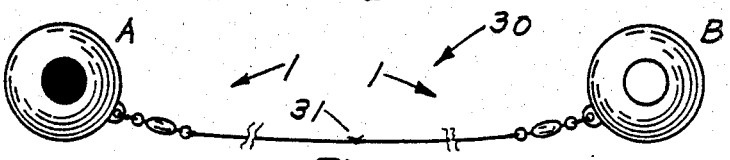
FIG. 6 is a side view of two non-anchored tether balls connected together which serve as mobile goals for teams "A" and "B"

FIG. 1 shows components of a typical tether ball system which is generally indicated by numeral 1, in which standard tether ball 2 has a diameter of about 8 to 9 inches (20.3 to 22.9 cms). Circle 3 on ball 2 indicates team designation marker for teams "A", "B", and "C" as shown above and to right of ball 2. Attachment loop 4 on ball 2 receives short tether rope 5 which in turn connects to eyelet of swivel 6, with other eyelet of swivel 6 connecting long tether rope 5, which in turn connects to stake 7 driven in playing surface 8 and underlying material 9. FIG. 2 shows portion of tether system using inverted "U" pin 10 as tether anchor. In general, anchor stake 7 is preferred for use in extremely hard but penetrable playing surfaces and underlying materials. Stake can be driven with hammer or mallet. Inverted "U" pin 10 is better for soft playing surface and underlying material and can be pushed in place by hand or foot. FIGS. 3 and 4 show optional weighted tether anchor 11 with tether attachment loop 12 on top. An impenetrable playing surface 14 with underlying material (concrete) 13 shows why a weighted anchor is desirable to secure tether ball. FIG. 5 shows standard football (soccer ball) generally indicated by numeral 20 which is used as the free ball in all subject game play. FIG. 6 shows a two tether ball system 30 comprising two of the one ball systems 1 connected (tied) together but with no anchor means, with tie knot indicated by number 31. Mobile team goals of system 30 are designated by solid black circle and blank circle on balls for teams "A" and "B" respectively. These mobile goals are free to be kicked in game play for any team advantage, with the basic idea of having the free football (soccer ball) strike a mobile team goal ball for point score. Swivels on all tether ball systems tend to reduce twisting and tangling of tether ropes. Tethers can have a wide range of lengths, from 1 to 5 yds (mts) for one ball systems, and double that length range for two ball systems.

Figure 7:
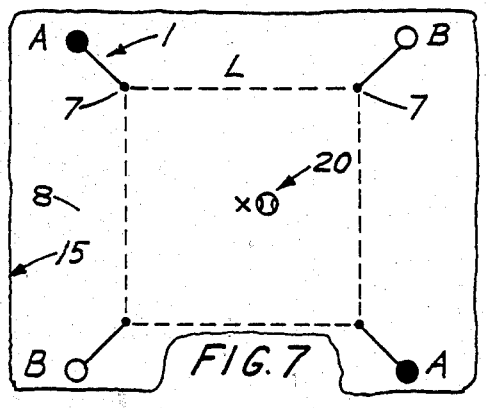
FIG. 7 is a plan view of a square field pattern for two team game using four mobile goals, two for each team.
Figure 10:
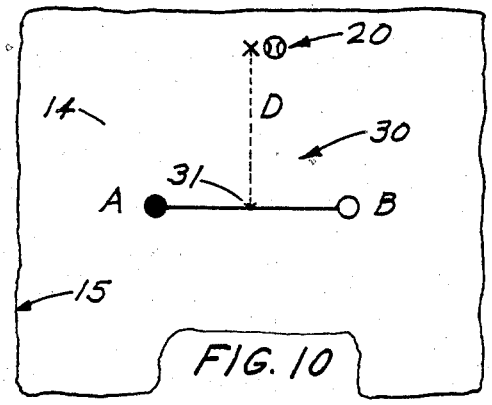
FIG. 10 is a plan view of a field pattern using a pair of tether balls connected together to form two free-to-move non-anchored mobile goals for two team play.

FIGS. 7 and 10 show various field patterns for game play. Common items for most patterns include one ball tether system 1, with anchor stake 7, penetrable playing surface 8, playing area 15 (restricted in drafting size due to sheet limitations), free football (soccer ball) 20, an "X" mark which indicates start point for game play, and an "L" designation which indicates tether ball anchor spacing distance. FIG. 7 shows square field pattern for two team game using four mobile goals, two for team "A" and two for team "B", with "L" distance ranging from 8 to 20 yds (mts), with like goals anchored individually at diagonally opposite corners of square. Playing surface can be fairly smooth and level grass, dirt, or sand. Overall playing area 15 should be at least 30 yds (mts) square. No field markings or boundary lines are required. Assumed or marked outer boundary lines can be used if so desired. Start point "X" is assumed or marked in center of square. Imaginary lines (dashed) connect anchor means at corner of square. A referee and score keeping means should be available for formal game play. Team players can number from 5 to 10 per side for game pattern in FIG. 7. To start game play using pattern in FIG. 7, place all mobile goal balls radially outward from center of square with tether ropes taut. Next, select two opposing players and have them stand at point "X" in center of square, with all other players beyond imaginary square pattern lines. Referee than drops football (soccer ball) between starting players and game is underway. Team players attempt to gain ball possession and score goal by kicking free ball against either of their team's mobile goal balls for a one point score. Only conventional football (soccer) play is permitted. But in addition to kicking the free ball, players can kick any goal ball to gain play advantage in an attempt to score a goal or prevent a score by opponent. However, players must not purposely kick or hinder movement of tether rope. Major or minor penalties or both can result from such prohibited play. In general, minor penalties are assessed for minor fouls or violation, and major penalties are assessed for dangerous fouls or major violations. Where foul is committed by opposing team in obvious scoring situation and goal is missed, score can be awarded and major or minor penalty also assessed, depending on judgement by referee. Foul by ball possession team always results in loss of ball. In general, foul of minor type by opposing team (without ball) can result in loss of future ball possession at any time in restart of play for any reason. Details related to major penalties and resulting penalty kicks are discussed at end of description of the various field patterns of play. Restart of play after score is made by player of scored-on team at point 3 yds (mts) from behind outstretched scored-on goal ball in radial pattern, with all other players at least 3 yds (mts) back from starter. Restart of play after foul is from point of foul with all players and any goal ball at least 3 yds (mts) back from starter. If free ball goes out-of-bounds, it is brought in as in conventional football (soccer). To prevent intentional game delay, free ball must touch ground within square pattern in time period of 20 seconds if in continuous possession by one team or ball possession is lost.

Figure 8:
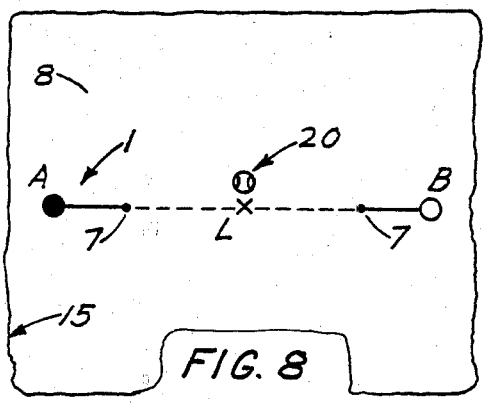
FIG. 8 is a plan view of a linear field pattern for two team game using two mobile goals, one for each team.

Game play using linear field pattern of FIG. 8 is essentially the same as for the square field pattern linear pattern is more suitable for smaller playing area and smaller team size. Only total of two mobile goals is used. Game is started with two opposing players at point "X" with all other players behind imaginary lines through the tether anchor points and perpendicular to dashed line between tether anchor points. Anti-game delay rule requires that free ball cross between anchor means at ground level in 20 second time period while ball is in possession of one team or ball possession is lost.

Figure 9:
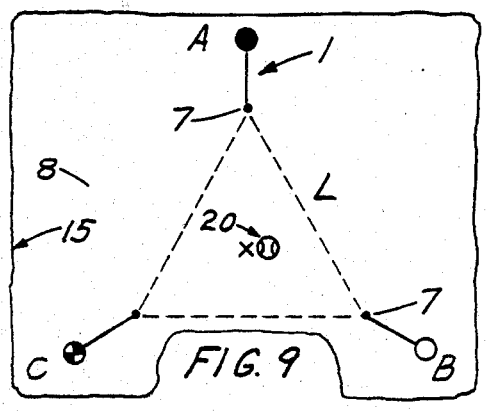
FIG. 9 is a plan view of triangular field pattern for a three team game using three mobile goals.

Game play using triangular field pattern of FIG. 9 is essentially the same as that of square pattern of FIG. 7, except that three teams are competing in game using three mobile goals designated as goals "A", "B", and "C". The tether anchor distance spacing "L" is same as in FIG. 7, ranging from 8 to 20 yds (mts). To start play, three opposing players stand at "X" mark at center of triangle and referee drops ball, with all other players beyond triangle pattern.

Game play using a non-anchored tether ball pair of mobile goals of FIG. 10 is quite different from the other field patterns described. Play is suitable on practically any type of smooth and level surface with the minimum of equipment and set-up effort, indoors or outdoors, since no tether anchors are required and since the paired tether balls will not roll too freely even on a smooth surface. Play can be in a small area and with a minimum number of players using a short tether. With a longer tether, more players can readily participate. To score a goal, play requires close-up skill, strategy, and teamwork. Power has no advantage in this type of play. Also, play must be directed at all three balls at same time, thus requiring some new strategy in the game of football (soccer). To start play, two opposing players stand at "X" mark with all other players beyond outstretched tether as shown in FIG. 10. In game play, if tethered pair of balls is dislocated too far from center of playing area, referee can stop play and reset pair, with ball possession being retained by same team. Anti-game delay rule requires that free ball cross between mobile goals at ground level in 20 second time period while in possession of one team or ball possession is lost. The "D" distance shown in FIG. 10 is set-back of "X" mark from tether for start of play should be at least 5 yds (mts).

In most sports and games, major fouls and violations and resulting major penalties are very important and can have a significant impact on safety and score of game. Subject games are no exception. In general, a major penalty is assessed in game play for dangerous play or for illegal play that prevents an obvious goal score. In the latter case, the score can be awarded with some additional minor penalty such as loss of ball possession or a future ball possession. If appropriate, a penalty kick can be awarded to give deserving team a reasonable change to make a score. The specific maneuver in a penalty kick should be designed to give at least a 75% chance of scoring, comparable to that of conventional football (soccer). One type of penalty kick used in square field pattern as in FIG. 7 is as follows: (a) position all goal balls as at start of game; (b) place selected penalty kicker and free ball next to one of his goal balls; (c) all defending players must be stationed in triangle nearer to kicker formed by center diagonal line across square connecting anchors of defending team goals; (d) all players of kicking team must be on far side of same center diagonal (remote from kicker) but not necessarily in triangle; (e) after proper wait and when referee signals; free ball must be kicked by penalty kicker and all other players are free to move; (f) kicking team tries to score goal before defending team gains good field positions; (g) kicking team can score at either goal after free ball crosses center diagonal, but defending team can not score on penalty try; (h) if defending team makes any kind of foul on try, a goal is awarded to kicking team; (i) after 10 seconds, try period is over and normal play starts if no goal is scored; (j) if score is made, one point is awarded and game is restarted as previously described. Modified versions of above penalty try can be used with other field pattern games. Another form of penalty that might be used is that of removing offending player from game of a definite time period as in ice hockey.

The invention may be embodied in other specific forms without departing from the spirit or essential attributes thereof and, accordingly, references should be made to the attached claims, rather than to the foregoing description as indicating the scope of the invention.

I claim:

1. Football (soccer) game with mobile goals comprising two footballs (soccer balls), one of which includes indicia designating the team "A" goal and one of which includes different indicia designating the team "B" goal, with a 2 to 10 yds (mts) tether therebetween, a free football (soccer ball), a playing surface, and a playing area, whereby competing teams can play a modified version of conventional football (soccer) game.

2. Game and apparatus comprising a fairly smooth and level playing surface with frictional characteristics such as those of grass, dirt and sand, two inflated spherical goal balls, one of which includes indicia designating a team "A" goal and one of which includes different indicia designating a team "B" goal, with a 2 to 10 yds (mts) tether therebetween, each of said tethered balls resting on said surface and adapted to move freely within the constraint of said tether in response to being kicked by the players, and a third inflated spherical free ball normally resting on said surface, whereby two competing teams can play a modified version of conventional football (soccer) game by kicking said tethered balls into advantageous positions and by attempting to kick the said free ball against an appropriate said tethered ball goal for a goal score.

3. Game and apparatus of claim 2 wherein said tether includes at least one swivel therein.

4. Game and apparatus of claim of claim 2 wherein all said inflated balls are comparable to conventional footballs (soccer balls).

* * * * *